US006208829B1

(12) United States Patent
Shimoda

(10) Patent No.: US 6,208,829 B1
(45) Date of Patent: Mar. 27, 2001

(54) APPARATUS AND METHOD USED FOR FORMING A MATRIX OF DOTS AS A LATENT IMAGE ON PHOTOGRAPHIC PAPER

(75) Inventor: Tomoyuki Shimoda, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/363,640

(22) Filed: Jul. 30, 1999

(30) Foreign Application Priority Data

Aug. 3, 1998 (JP) ..... 10-219487

(51) Int. Cl.[7] ..... G03G 21/00
(52) U.S. Cl. ..... 399/366
(58) Field of Search ..... 399/219, 366; 355/1; 503/201; 356/372

(56) References Cited

U.S. PATENT DOCUMENTS 5,528,371 * 6/1996 Sato et al. ..... 356/372
5,752,152 * 5/1998 Gasper et al. ..... 399/366
5,768,674 * 6/1998 Gasper et al. ..... 399/366
5,864,742 * 1/1999 Gasper et al. ..... 399/366
5,919,730 * 7/1999 Gasper et al. ..... 503/201

* cited by examiner

*Primary Examiner*—Fred L Braun
(74) *Attorney, Agent, or Firm*—Sughrue, Mion, Zinn, Macpeak & Seas, PLLC

(57) ABSTRACT

An apparatus and an associated method for manufacturing a photographic paper. The apparatus allows a matrix of dots to be formed as a latent image on the photographic paper at a first pitch in a horizontal direction, and a second pitch in a vertical direction. The apparatus includes an exposure head which has an array of LED elements, a feed mechanism for feeding the photographic paper, a fiber array of light transmission members (second plastic fibers) arranged at a first pitch for transmitting light from the exposure head to the photographic paper, a light guide for guiding the light from the exposure head to the fiber array, and a light emission controller for energizing all the LED elements of the exposure head each time the photographic paper is fed a second pitch. The apparatus allows dots to be formed as a latent image on the photographic paper which have clear profiles and are free of density variations. This helps prevent unauthorized copying of a photographed image on the paper by an image reading device.

32 Claims, 11 Drawing Sheets

APPARATUS AND METHOD USED FOR FORMING A MATRIX OF DOTS AS A LATENT IMAGE ON PHOTOGRAPHIC PAPER

BACKGROUND OF THE INVENTION

1. Field of the Invention

The present invention relates to an apparatus for and a method of manufacturing a photographic paper which is capable of preventing a photographed image thereon from being copied unauthorizedly by an image reading device.

2. Description of the Related Art

There has recently been proposed and used a photographic paper with a matrix of dots, each about 0.1 mm across, formed as a latent image at a pitch of 2.25 mm on the entire surface thereof. The dots will be seen as yellow dots after the picture on the photographic paper is developed. The photographic paper has been developed to prevent a photographed image thereon from being duplicated unauthorizedly for the purpose of protecting copyrights of commercial photographers.

Recently available image reading devices have their performance greatly improved to the point where they can produce copies as comparable to photoprints. Stated otherwise, a copy of a photoprint can easily be produced by a modern image reading device, rather than going to the trouble of producing a photoprint from an original negative.

Since unauthorized duplication of a photoprint with an image reading device is illegal, some measures must be taken to prevent such unauthorized photoprint duplication. Unauthorized photoprint copying poses a social problem as it tends to reduce the income of commercial photographers.

One scheme for preventing the unauthorized photoprint duplication is to form a latent image of dots on a photographic paper, as described above. Specifically, an image reading device incorporates a function (software-implemented function) to detect a matrix of developed dots, and can detect a regular pattern of dots on a photographic paper. When the image reading device detects such dots on a photographic paper, the image reading device produces a warning indicating that copying the image on the photographic paper will be unauthorized photoprint duplication, and stops reading the image on the photographic paper.

The developed dots are invisible to the naked eye because they are very small in size and yellow in color. Therefore, the dots do not impair the quality of photoprints.

SUMMARY OF THE INVENTION

It is an object of the present invention to provide an apparatus for and a method of manufacturing a photographic paper by forming latent-image dots with clear profiles and free of density variations on the photographic paper.

Another object of the present invention is to provide an apparatus for and a method of manufacturing a photographic paper with a number of latent-image dots formed thereon highly efficiently by way of easy image focusing upon exposure to spots of light.

Still another object of the present invention is to provide an apparatus for and a method of manufacturing a photographic paper which is capable of effectively preventing a printed image thereon from being copied unauthorizedly with latent-image dots with clear profiles and free of density variations being formed on the photographic paper.

The above and other objects, features, and advantages of the present invention will become apparent from the following description when taken in conjunction with the accompanying drawings in which preferred embodiments of the present invention are shown by way of illustrative example.

DESCRIPTION OF THE PREFERRED EMBODIMENTS

Embodiments of an apparatus for and a method of manufacturing a photographic paper, as applied to an apparatus for forming a number of dots as a latent image on a photographic paper by exposure to spots of light will be described below with reference to FIGS. 1 through 11.

Figure 1:
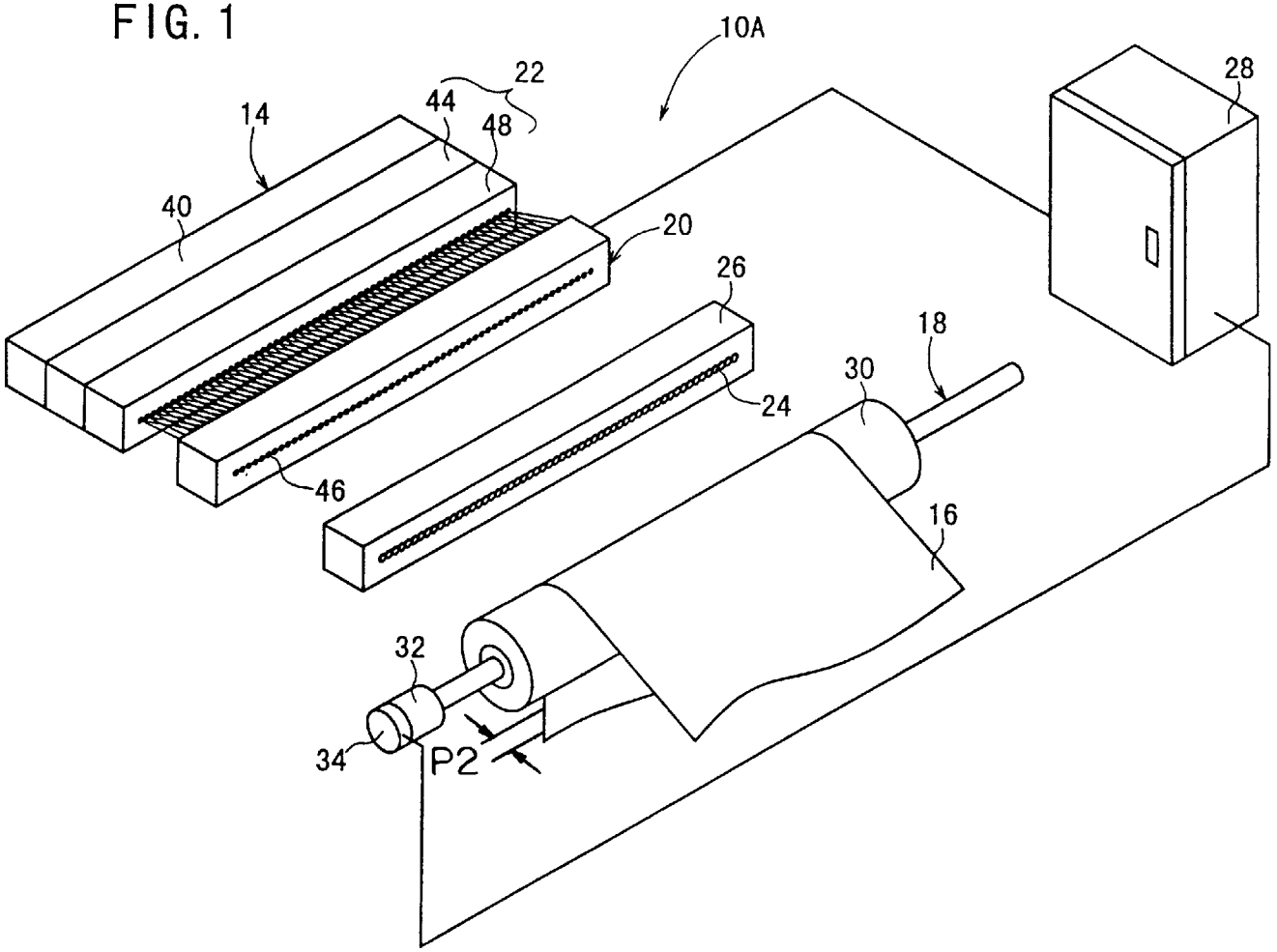
FIG. 1 is a schematic perspective view of an apparatus for manufacturing a photographic paper according to a first embodiment of the present invention.
Figure 2:
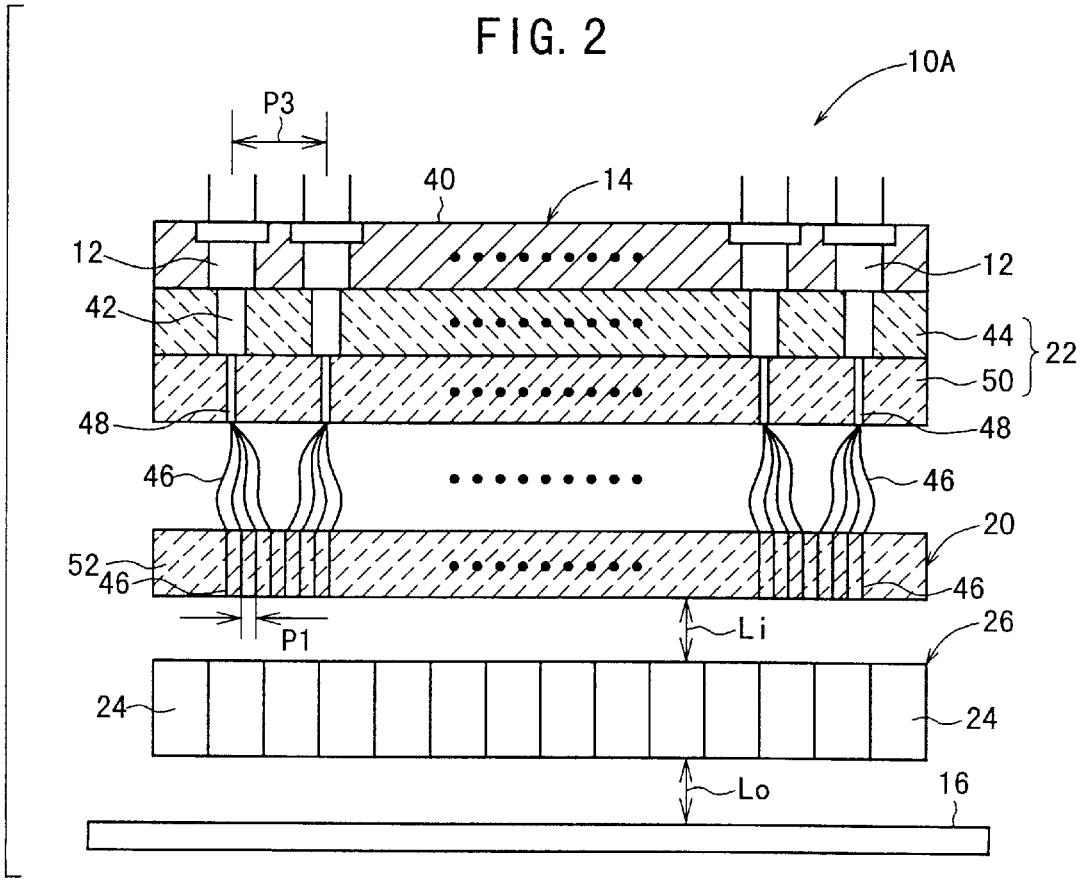
FIG. 2 is a schematic cross-sectional view of the apparatus shown in FIG. 1.

As shown in FIGS. 1 and 2, an apparatus 10A according to a first embodiment of the present invention comprises an exposure head 14 having an array of LED (Light-Emitting Diodes) elements 12, a feed mechanism 18 for feeding an elongate photographic paper 16, a fiber array 20 having an array of light transmission members (second plastic fibers 46) arranged at a first pitch P1 for transmitting light from the exposure head 14 to the photographic paper 16, a light guide 22 for guiding the light from the exposure head 14 to the fiber array 20, a lens array 26 disposed between the fiber array 20 and the photographic paper 16 and comprising an array of lenses 24, and a light emission controller 28 for energizing the LED elements 12 of the exposure head 14 each time the photographic paper 16 is fed a second pitch P2.

As shown in FIG. 1, the feed mechanism 18 comprises a roller 30 for transporting the elongate photographic paper 16 in its longitudinal direction, a motor 32 for rotating the rollor 30 in a normal direction or a reverse direction, and a rotary encoder 34 coupled to the shaft of the motor 32. The feed mechanism 18 may be combined with a device for feeding and processing the elongate photographic paper 16, such as a slitter, a rewinder, a splicer, or the like for the elongate photographic paper 16.

As shown in FIG. 2, the exposure head 14 has a box-shaped housing 40 which supports the LED elements 12 at a third pitch P3.

Each of the first pitch P1 and the second pitch P2 is of 2.25 mm, for example, and the third pitch P3 is of 9 mm, for example.

As shown in FIG. 2, the light guide 22 comprises a number of first plastic fibers 42 each having a diameter of 1 mm, for example, a first box-shaped housing 44 which supports the first plastic fibers 42 at a pitch that is the same as the pitch of the LED elements 12, i.e., the third pitch P3, a number of second plastic fibers 46 each having a diameter of 0.1 mm, for example, and a second box-shaped housing 50 supporting bundles 48 of the second plastic fibers 46, each bundle 48 comprising four or five second plastic fibers 46, at a pitch that is the same as the pitch of the LED elements 12, i.e., the third pitch P3.

The second housing 50 supports ends of the bundles 48, 10 whose opposite ends extend away from the second housing 50.

The fiber array 20 comprises a box-shaped housing 52 supporting the opposite ends of the bundles 48, i.e., the second plastic fibers 46, at the first pitch P1. The second plastic fibers 46 supported by the housing 52 emit a corresponding number of spots of light, each having a diameter of 0.1 mm, spaced at the first pitch P1, from a principal surface of the housing 52 toward the photographic paper 16.

Each of the housing 40 of the exposure head 14, the first and second housings 44, 50 of the light guide 22, and the housing 52 of the fiber array 20 may be made of a synthetic resin such as an opalescent synthetic resin or a metal such as aluminum which is impermeable to light.

The lens array 26 is spaced from the fiber array 20 by a distance Li and from the photographic paper 16 by a distance Lo. With these distances Li, Lo being equalized to each other, each of the lenses 24 of the lens array 26 can output an image which is of the same size as an inputted image from the fiber array 20. Therefore, each of the lenses 24 of the lens array 26 can focus an image which is of the same size as an inputted image onto the photographic paper 16.

Therefore, an image formed by a number of spots of light emitted from the fiber array 20 is focused onto the photographic paper 16 by the lens array 26.

Figure 3:
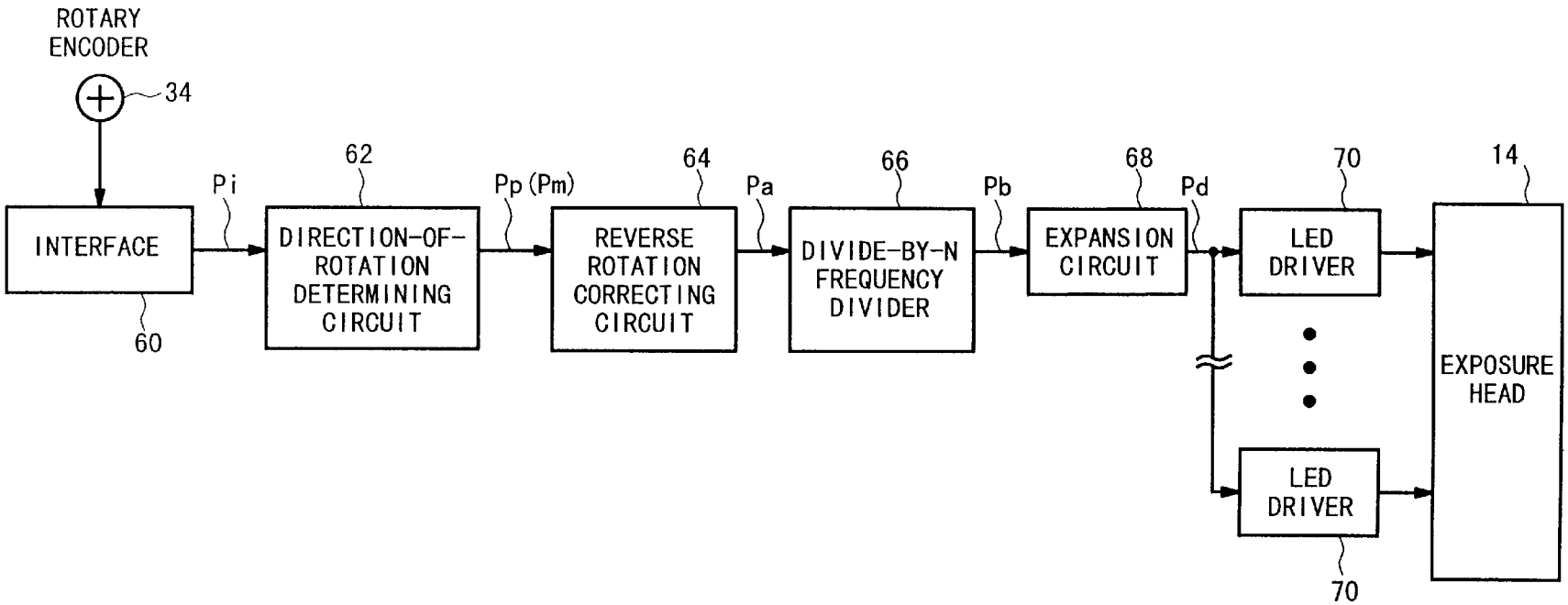
FIG. 3 is a block diagram of a light emission controller of the apparatus shown in FIG. 1.

As shown in FIG. 3, the light emission controller 28 comprises an interface 60, a direction-of-rotation determining circuit 62, a reverse rotation correcting circuit 64, a divide-by-N frequency divider 66, an expansion circuit 68, and a plurality of LED drivers 70.

The direction-of-rotation determining circuit 62 detects a direction of rotation of the motor 32 based on a train of pulses Pi supplied from the rotary encoder 34 via the interface 60. If the detected direction of rotation of the motor 32 is a normal direction, then the direction-of-rotation determining circuit 62 outputs a positive pulse Pp, and if the detected direction of rotation of the motor 32 is a reverse direction, then the direction-of-rotation determining circuit 62 outputs a negative pulse Pm.

The reverse rotation correcting circuit 64 has a counter therein which increments its count by 1 each time it is supplied with a positive pulse Pp from the direction-of-rotation determining circuit 62 and decrements its count by 1 each time it is supplied with a negative pulse Pm from the direction-of-rotation determining circuit 62. Only when the count of the counter is 0 and the reverse rotation correcting circuit 64 is supplied with a positive pulse Pp from the direction-of-rotation determining circuit 62, the reverse rotation correcting circuit 64 outputs a normal rotation pulse Pa. The reverse rotation correcting circuit 64 thus arranged serves to prevent an area of the photographic paper 16 which has once been exposed to spots of light to form a latent image thereon, from suffering double exposure to spots of light.

The divide-by-N frequency divider 66 frequency-divides normal rotation pulses Pa from the reverse rotation correcting circuit 64, and outputs one detected pulse Pb when the photographic paper 16 is fed a desired distance. For example, it is assumed that the roller 30 has an outer circumferential length of 162 mm and the rotary encoder 34 outputs 3600 pulses Pi each time the roller 30 makes one revolution. If the divide-by-N frequency divider 66 outputs a detected pulse Pb each time it counts 50 normal rotation pulses Pa, then the divide-by-N frequency divider 66 outputs a detected pulse Pb each time the photographic paper 16 is fed by 2.25 mm (=second pitch P2).

The expansion circuit 68 generates an expanded drive pulse Pd when it is triggered by a detected pulse Pb from the divide-by-N frequency divider 66. The drive pulse Pd, whose pulse duration represents a light emission period, is supplied simultaneously to all the LED elements 12. The light emission period ranges from 500 ns to 60 $\mu$s.

Figure 4:
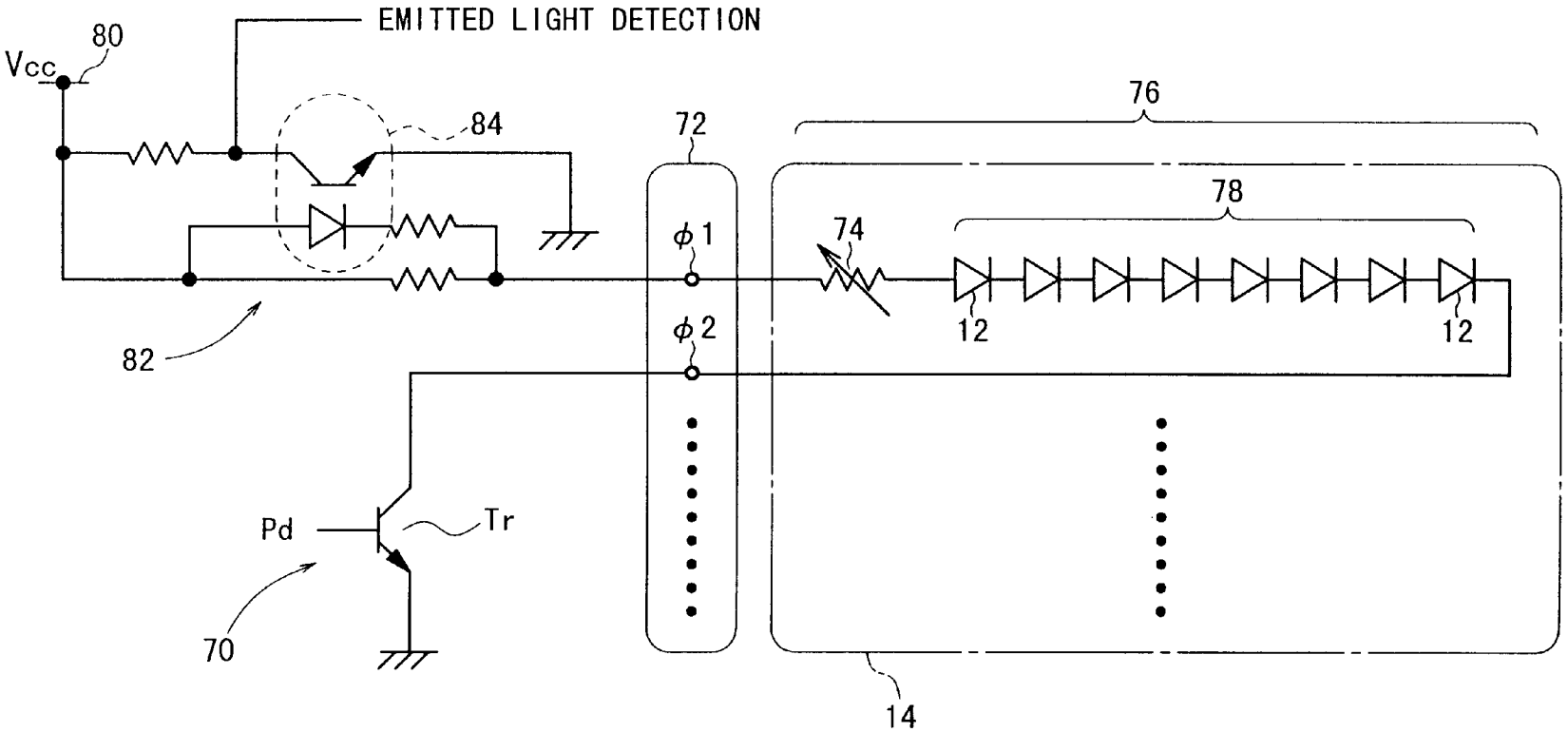
FIG. 4 is a circuit diagram of an LED driver and a self-diagnosing circuit of the apparatus shown in FIG. 1.

As shown in FIG. 4, each of the LED drivers 70 comprises a single npn transistor Tr having a base terminal for being supplied with the drive pulse Pd from the expansion circuit 68, an emitter terminal to which a ground potential is applied, and a collector terminal connected to the cathode of an LED element 12.

The light emission controller 28 and the exposure head 14 are connected to each other by a connector 72. The connector 72 has a number of terminals grouped into sets of two adjacent terminals $\phi 1$, $\phi 2$. Eight LED elements 12, for example, are connected in series to each other, a variable resistor 74 is connected to the anode of a first one of the LED elements 12, thus making a series-connected circuit, which is connected to each of the sets of two adjacent terminals $\phi 1$, $\phi 2$. Those series-connected eight LED elements 12 will hereinafter be referred to as an LED group 78.

The collector terminal of the npn transistor Tr of the LED driver 70 is connected to the terminal $\phi 2$ to which the cathode of a final one of the eight LED elements 12 of the LED group 78. The terminal $\phi 1$ to which the anode of the first one of the LED elements 12 of the LED group 78 is connected is connected to a power supply line 80.

When a high-level signal, i.e., the level of a drive pulse Pd in its pulse duration, is supplied to the base terminal of the npn transistor Tr of the LED driver 70, the npn transistor Tr is turned on, allowing a drive current to flow from the power supply line 80 to the corresponding LED group 78 to enable the LED group 78 to emit light.

Since the drive pulse Pd is supplied from the expansion circuit 68 simultaneously to all the LED drivers 70, all the LED elements 12 emit light for the pulse duration of the drive pulse Pd.

The variable resistor 74 serves to adjust the drive current flowing through the LED elements 12 to minimize variations in the light emission intensity between the LED groups 78.

Furthermore, a self-diagnosing circuit 82 for detecting whether a drive current is supplied to an LED group 78 or not is connected between the corresponding terminal $\phi 1$ and the power supply line 80. The self-diagnosing circuit 82 comprises a photocoupler 84, for example.

Operation and advantages of the apparatus 10A constructed as described above according to the first embodiment of the present invention will be described below.

As shown in FIG. 1, when the motor 32 of the feed mechanism 18 is energized, the roller 30 is rotated about its own axis to feed the photographic paper 16. As the photographic paper 16 is fed, the rotary encoder 34 outputs a train of pulses Pi depending on the angular displacement of the shaft of the motor 32. The pulses Pi from the rotary encoder 34 are successively supplied to the light emission controller 28.

In the light emission controller 28, the direction-of-rotation determining circuit 62 and the reverse rotation correcting circuit 64 count only pulses indicative of the normal direction of rotation of the motor 32 among the supplied pulses Pi, and the divide-by-N frequency divider 66 and the expansion circuit 68 generate a drive pulse Pd each time the photographic paper 16 is fed the second pitch P2, for thereby energizing all the LED elements 12 of the exposure head 14 to emit light for a predetermined period of time.

As shown in FIG. 2, light emitted from one LED element 12 passes through a corresponding first plastic fiber 42 in the light guide 22 and a corresponding bundle 48 of second plastic fibers 46, and then passes through four or five second plastic fibers 46 corresponding to the bundle 48 toward the photographic paper 16.

The above light emission and transmission is carried out by all the LED elements 12, so that light beams emitted from all the second plastic fibers 46 travel toward the photographic paper 16.

An image formed by the light beams emitted from the second plastic fibers 46 passes through the lens array 26 and is focused onto the photographic paper 16. A number of dots arranged at the first pitch P1 in the horizontal direction are thus formed as a latent image on the photographic paper 16 by exposure to the beams of light.

The above operation is repeated as the photographic paper 16 is intermittently fed the second pitch P2 by the feed mechanism 18. In this manner, a matrix of dots arranged at the first pitch P1 in the horizontal direction and the second pitch P2 in the vertical direction is formed as a latent image on the entire surface of the photographic paper 16.

After the latent-image dots have been developed, they are invisible to the naked eye because each of the dots has a diameter of 0.1 mm and is very small. Each of the dots is blue in color with a color density ranging from about 0.2 to 0.6.

Since the apparatus 10A according to the first embodiment employs the exposure head 14 which has the array of LED elements 12 as light sources for producing dots as a latent image on the photographic paper 16, latent-image dots having a uniform density can be formed on the photographic paper 16.

According to the first embodiment, particularly, because the light guide 22 is provided to guide light from the exposure head 14 toward the fiber array 20, light from one LED element 12, for example, can be guided to a plurality of light transmission members (four of five second plastic fibers 46 in the first embodiment). Consequently, it is not necessary to employ as many LED elements 12 as the number of dots to be produced in the horizontal direction, and hence the apparatus 10A may be reduced in size. According to the first embodiment, furthermore, inasmuch as the lens array 26 comprising the lenses 24 is disposed between the fiber array 20 and the photographic paper 16, light that has passed through the fiber array 20 is focused onto the photographic paper 16 by the lens array 26. Therefore, it is possible to form latent-image dots with clear profiles and free of density variations on the photographic paper 16.

Moreover, the light emission controller 28 counts only pulses indicative of the normal direction of rotation of the motor 32 among pulses Pi successively supplied from the rotary encoder 34, and generates a drive pulse Pd each time the photographic paper 16 is fed the second pitch P2, for thereby energizing all the LED elements 12 of the exposure head 14 to emit light for a predetermined period of time corresponding to the pulse duration of the drive pulse Pd. When the pulse duration of the drive pulse Pd is selected depending on the speed at which the photographic paper 16 is fed by the feed mechanism 18, the dots may be made substantially circular or elliptical in shape.

In the first embodiment, the self-diagnosing circuit 82 for confirming the emission of light from each of the LED groups 78 is connected to the exposure head 14. Accordingly, it is easy to confirm whether desired dots have been formed as a latent image on the photographic paper 16 or not. The self-diagnosing circuit 82 can thus offer an advantage in the maintenance and management of the apparatus 10A.

An apparatus 10B according to a second embodiment of the present invention will be described below with reference to FIG. 5. Those parts of the apparatus 10B which correspond to those of the apparatus 10A according to the first embodiment shown in FIG. 1 are denoted by identical reference numerals, and will not be described in detail below.

Figure 5:
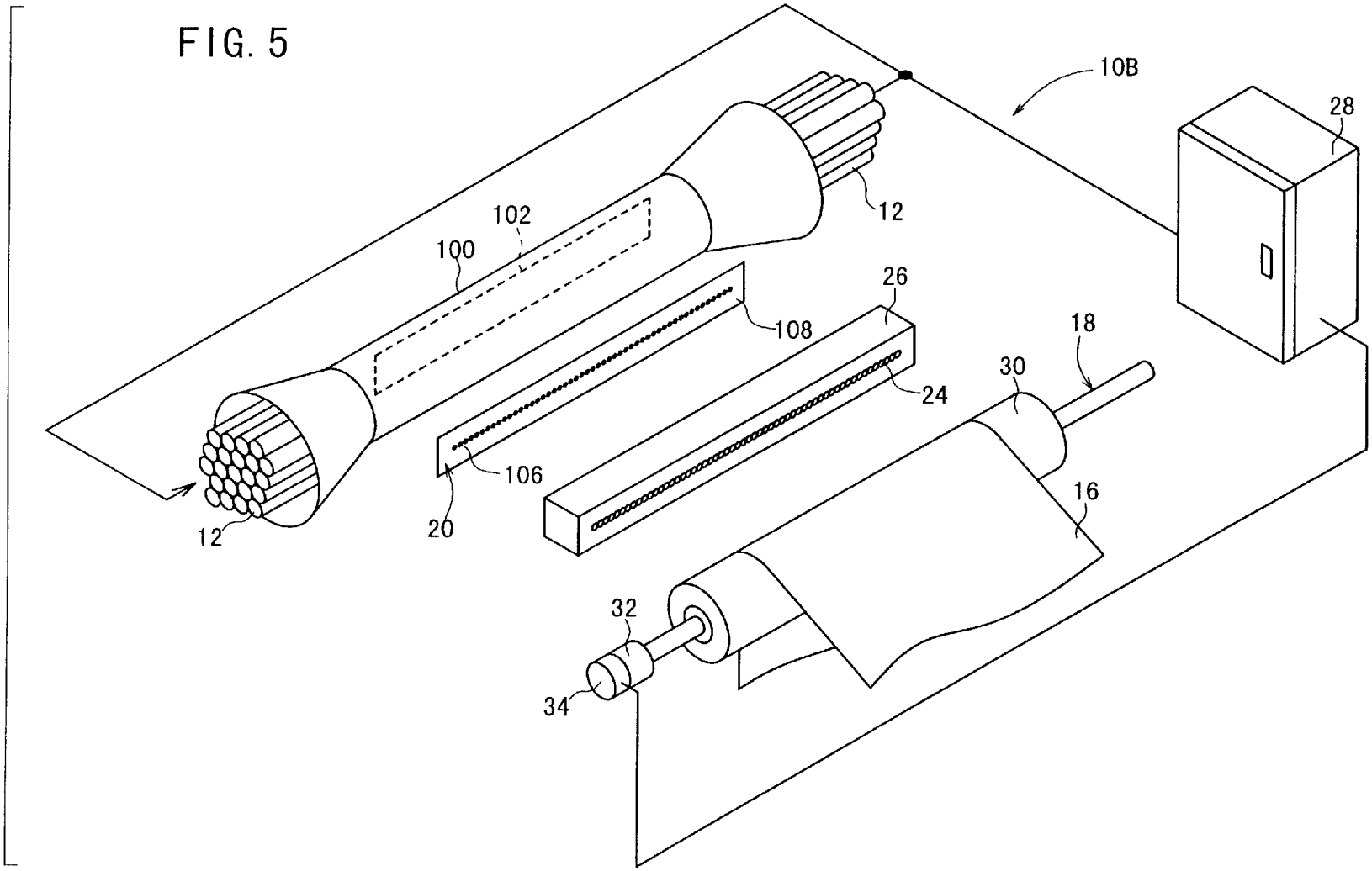
FIG. 5 is a schematic perspective view of an apparatus for manufacturing a photographic paper according to a second embodiment of the present invention.

As shown in FIG. 5, the apparatus 10B according to the second embodiment is of substantially the same structure as the apparatus 10A according to the first embodiment, but differs therefrom in that the light guide 22 comprises a light guide rod 100 of acrylic resin and a light diffusion film 102 attached to a rear surface of the light guide rod 100 remote from the photographic paper 16, the light comprises a number of LED elements 12 disposed on opposite ends of the light guide rod 100, and the fiber array 20 comprises a mask 108 having an array of openings 106 arranged at the first pitch P1.

The light guide rod 100 of acrylic resin may be a commercially available light guide rod of acrylic resin. Alternatively, a light guide rod of glass may be used in place of the light guide rod 100 of acrylic resin. The light diffusion film 102 may comprise a film made of barium sulfate only or a material containing barium sulfate. Alternatively, the light diffusion film 102 may comprise any film insofar as it can diffuse light applied thereto. The mask 108 may comprise a film of Cr (chromium) evaporated on a sheet of quartz or glass and having an array of openings 106, each having a diameter of about 0.1 mm, defined at the first pitch P1, or a metal mask comprising a thin sheet of metal having an array of openings 106, each having a diameter of about 0.1 mm, defined at the first pitch P1.

The apparatus 10B operates as follows: Light emitted from the light source, i.e., the LED elements 12, passes through the light guide rod 100, is diffused by the interface between the light diffusion film 102 and the light guide rod 100, and travels toward the photographic paper 16. On the way toward the photographic paper 16, the light passes through the openings 106 in the mask 108 and travels as beams of light each having a spot diameter of about 0.1 mm toward the photographic paper 16.

An image formed by the light beams emitted from the openings 106 in the mask 18 passes through the lens array 26 and is focused onto the photographic paper 16. A number of dots arranged at the first pitch P1 in the horizontal direction are thus formed as a latent image on the photographic paper 16 by exposure to the beams of light.

In the second embodiment, the light emission controller 28 also energizes the LED elements 12 for a predetermined period of time, i.e., the pulse duration of a drive pulse Pd, each time the photographic paper 16 is fed the second pitch P2 in the normal direction. Therefore, a matrix of dots arranged at the first pitch P1 in the horizontal direction and the second pitch P2 in the vertical direction is formed as a latent image on the entire surface of the photographic paper 16.

An apparatus 10C according to a third embodiment of the present invention will be described below with reference to FIGS. 6 and 7. Those parts of the apparatus 10C which correspond to those of the apparatus 10A according to the first embodiment shown in FIGS. 1 and 2 are denoted by identical reference numerals, and will not be described in detail below.

Figure 6:
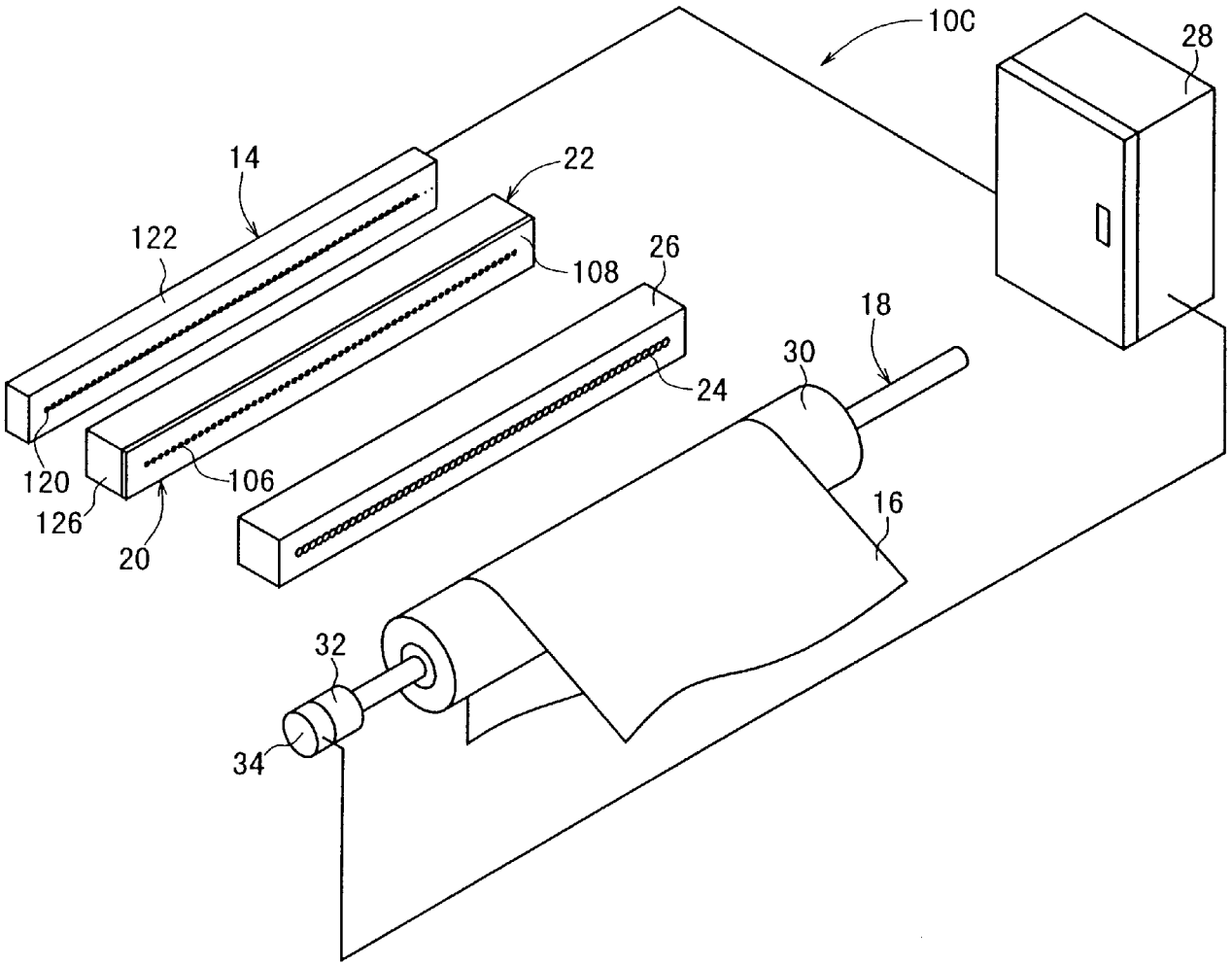
FIG. 6 is schematic perspective view of an apparatus for manufacturing a photographic paper according to a third embodiment of the present invention.
Figure 7:
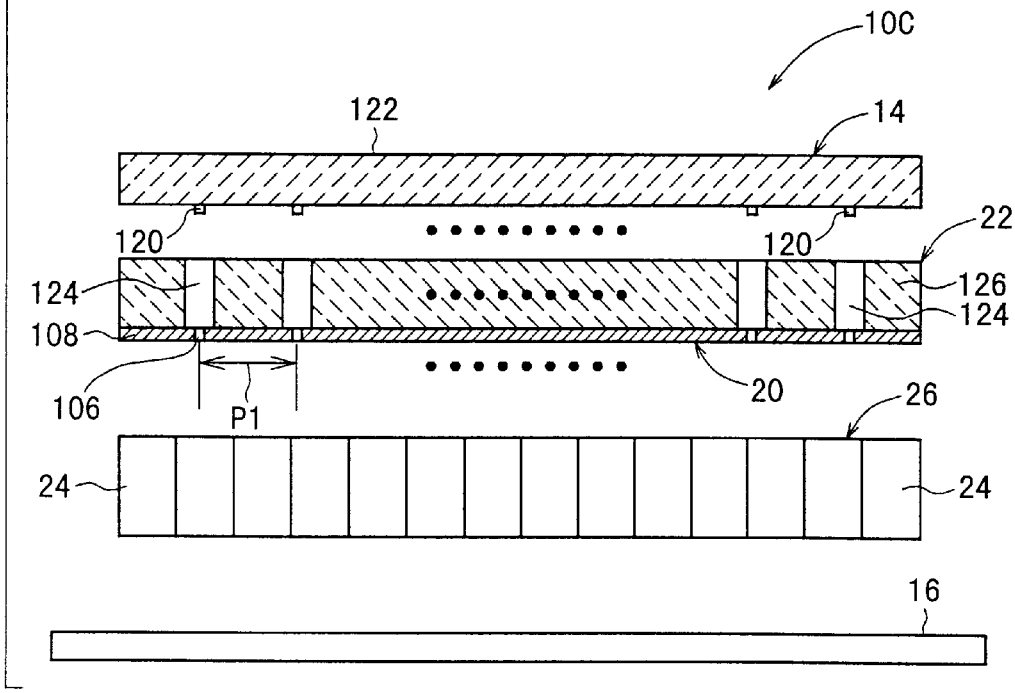
FIG. 7 is a schematic cross-sectional view of the apparatus shown in FIG. 6.

As shown in FIGS. 6 and 7, the apparatus 10C according to the third embodiment is of substantially the same structure as the apparatus 10A (see FIGS. 1 and 2) according to the first embodiment, but differs therefrom as follows:

As shown in FIG. 7, the exposure head 14 comprises an array of LED chips 120 each having sides each 0.3 mm long, and a plate-like board 122 on which the LED chips 120 are supported at the first pitch P1. The light guide 22 comprises a number of plastic fibers 124 each having a diameter ranging from 0.5 to 1 mm, and a box-shaped housing 126 which supports the plastic fibers 124 spaced at a pitch equal the first pitch P1.

The fiber array 20 comprises a mask 108 which is identical to the mask 108 of the apparatus 10B (see FIG. 5) according to the second embodiment. Thus, the mask 108 may comprise a film of Cr (chromium) evaporated on a sheet of quartz or glass and having an array of openings 106, each having a diameter of about 0.1 mm, defined at the first pitch P1, or a metal mask comprising a thin sheet of metal having an array of openings 106, each having a diameter of about 0.1 mm, defined at the first pitch P1.

The apparatus 10C operates as follows: Light emitted from the LED chips 120 passes through the plastic fibers 124 of the light guide 22 and then the opening 106 in the mask 108, and travels as beams of light each having a spot diameter of about 0.1 mm toward the photographic paper 16.

An image formed by the light beams emitted from the openings 106 in the mask 108 passes through the lens array 26 and is focused onto the photographic paper 16. A number of dots arranged at the first pitch P1 in the horizontal direction are thus formed as a latent image on the photographic paper 16 by exposure to the beams of light.

In the third embodiment, the light emission controller 28 also energizes all the LED chips 120 for a predetermined period of time, i.e., the pulse duration of a drive pulse Pd, each time the photographic paper 16 is fed the second pitch P2 in the normal direction. Therefore, a matrix of dots arranged at the first pitch P1 in the horizontal direction and the second pitch P2 in the vertical direction is formed as a latent image on the entire surface of the photographic paper 16.

In the apparatus 10C according to the third embodiment, each of the exposure head 14 and the fiber array 20 comprises a plate-like member. Therefore, it is possible to shorten the path of light from the LED chips 120 to the photographic paper 16. Accordingly, the densities of dots formed as a latent image on the photographic paper 16 may be rendered more uniform, and the apparatus 10C may be reduced in size.

Figure 8:
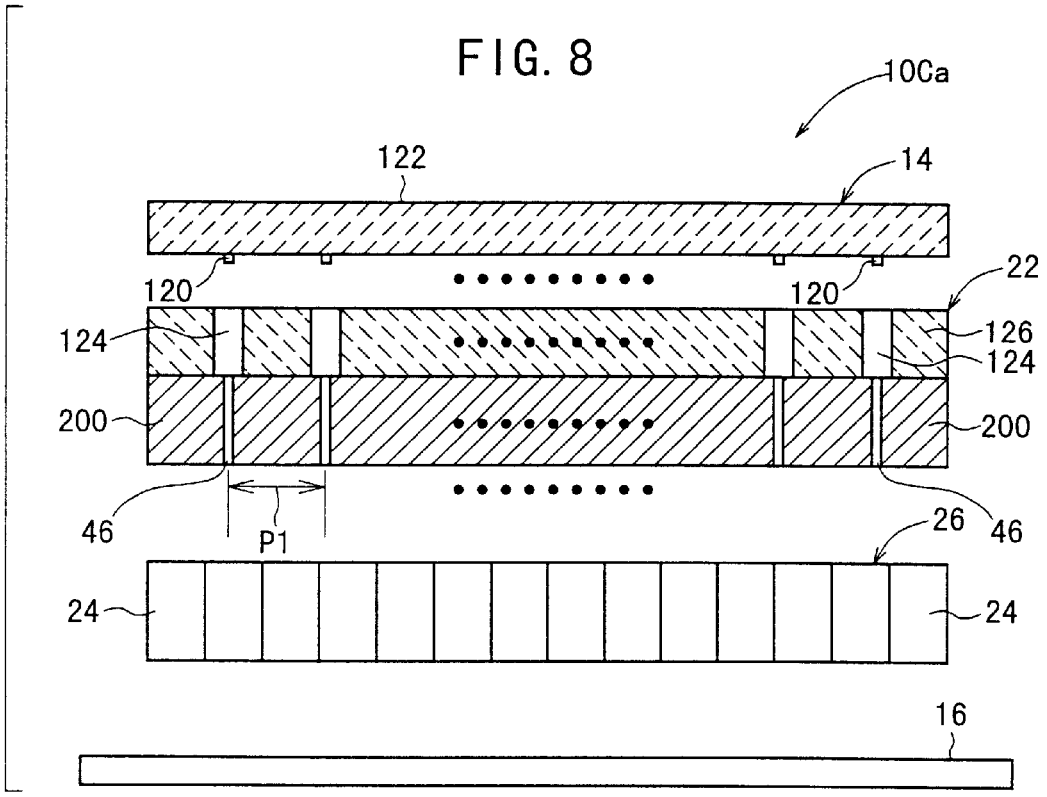
FIG. 8 is a schematic cross-sectional view of a modification of the apparatus shown in FIG. 6.

FIG. 8 shows a modification 10C*a* of the apparatus 10C. In the modified apparatus 10C*a*, the fiber array 20 comprises a number of plastic fibers 46 each having a diameter of 0.1 mm, for example, and a box-shaped housing 200 supporting the plastic fibers 46 at the second pitch P2.

An apparatus 10D according to a fourth embodiment of the present invention will be described below with reference to FIGS. 9 and 10. Those parts of the apparatus 10D which correspond to those of the apparatus 10C according to the third embodiment shown in FIGS. 6 and 7 are denoted by identical reference numerals, and will not be described in detail below.

Figure 9:
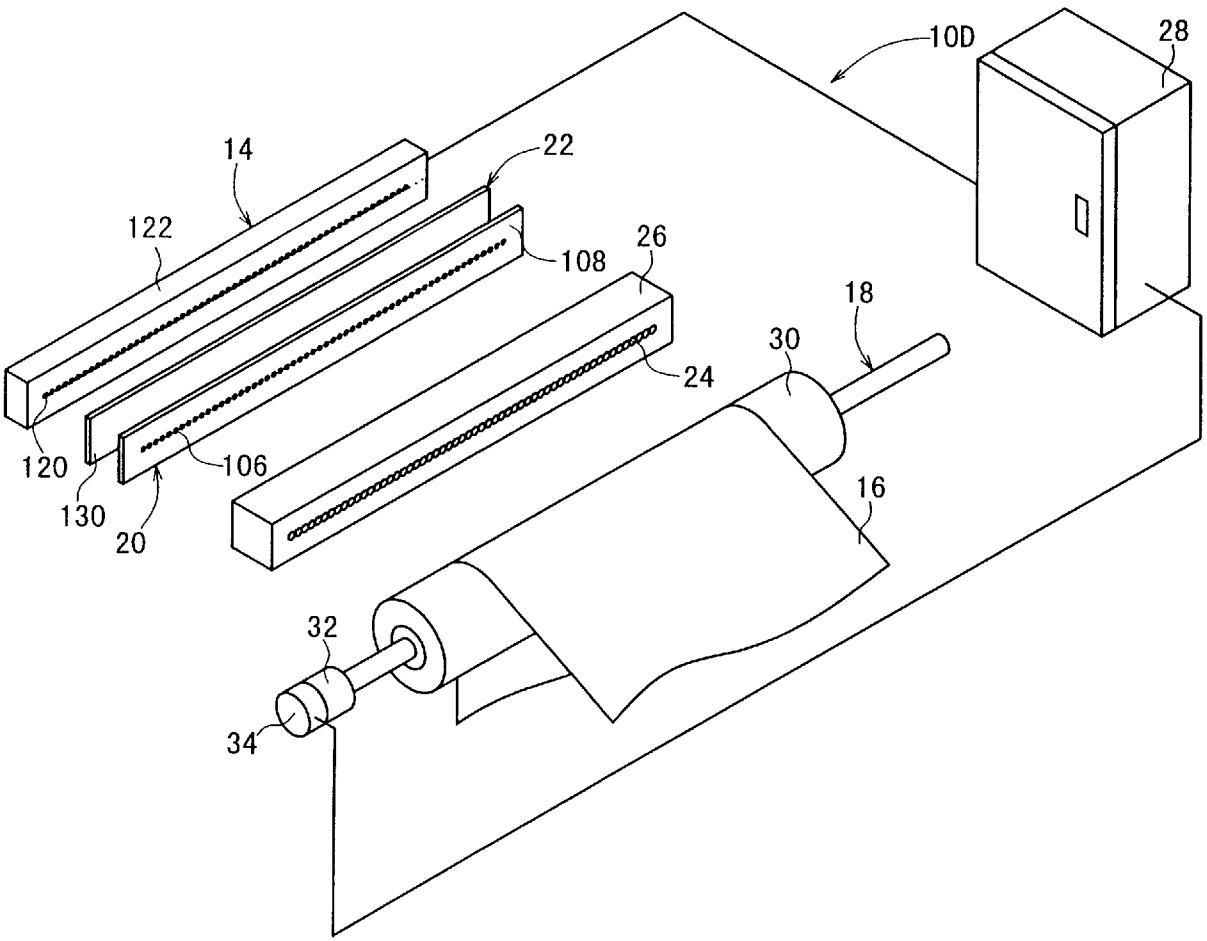
FIG. 9 is schematic perspective view of an apparatus for manufacturing a photographic paper according to a fourth embodiment of the present invention.
Figure 10:
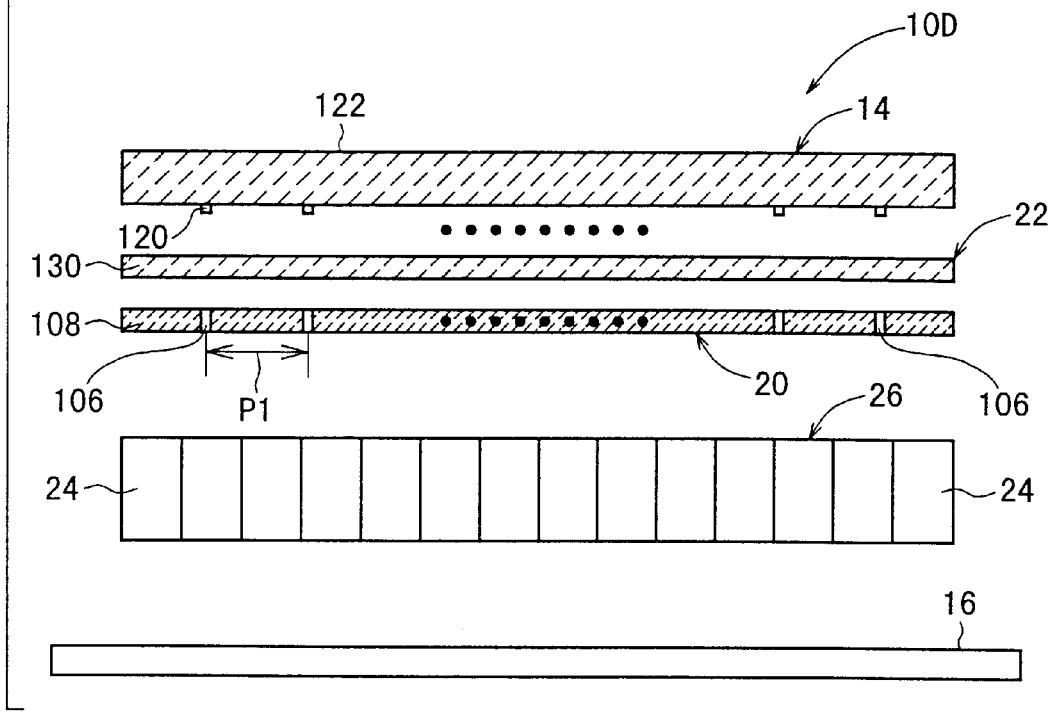
FIG. 10 is a schematic cross-sectional view of the apparatus shown in FIG. 9.

As shown in FIGS. 9 and 10, the apparatus 10D according to the fourth embodiment is of substantially the same structure as the apparatus IOC according to the third embodiment shown in FIGS. 6 and 7, but differs therefrom in that the light guide 22 comprises a diffusion plate (diffusion filter) 130.

The apparatus 10D operates as follows: Light emitted from the LED chips 120 is diffused by the diffusion plate 130 toward the photographic paper 16. The diffused light passes through the opening 106 in the mask 108, and travels as beams of light each having a spot diameter of about 0.1 mm toward the photographic paper 16.

An image formed by the light beams emitted from the openings 106 in the mask 108 passes through the lens array 26 and is focused onto the photographic paper 16. A number of dots arranged at the first pitch P1 in the horizontal direction are thus formed as a latent image on the photographic paper 16 by exposure to the beams of light.

In the fourth embodiment, the light emission controller 28 also energizes all the LED chips 120 for a predetermined period of time, i.e., the pulse duration of a drive pulse Pd, each time the photographic paper 16 is fed the second pitch P2 in the normal direction. Therefore, a matrix of dots arranged at the first pitch P1 in the horizontal direction and the second pitch P2 in the vertical direction is formed as a latent image on the entire surface of the photographic paper 16.

In the apparatus 10D according to the fourth embodiment, each of the exposure head 14, the light guide 22, and the fiber array 20 comprises a plate-like member. Therefore, it is possible to shorten the path of light and reduce the size of the apparatus 10D more effectively.

Figure 11:
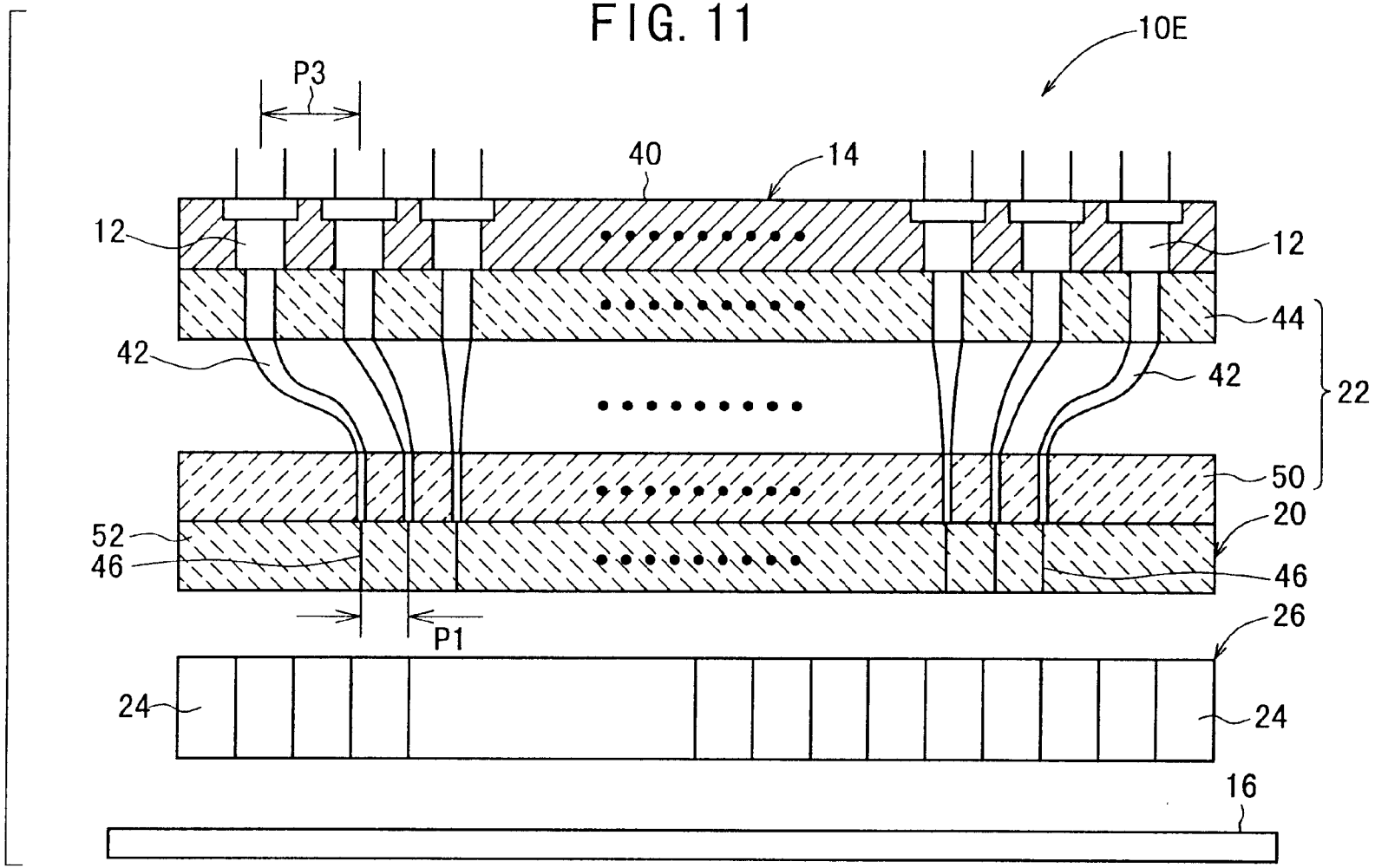
FIG. 11 is a schematic cross-sectional view of an apparatus for manufacturing a photographic paper according to a fifth embodiment of the present invention.

An apparatus 10E according to a fifth embodiment of the present invention will be described below with reference to FIG. 11. In the apparatus 10E according to the fifth embodiment, the light guide 22 comprises a first box-shaped housing 44 supporting ends of the plastic fibers 42, each having a diameter of about 1 mm, for example, at the third pitch P3, and a second box-shaped housing 50 supporting opposite ends of the plastic fibers 42 at the second pitch P2.

The fiber array 20 comprises a third box-shaped housing 52 supporting the plastic fibers 46, each having a diameter of about 0.1 mm, for example, at the second pitch P2.

In the apparatus 10E according to the fifth embodiment, the number of LED elements 12 used is increased. However, since one dot is produced by one LED element, when the physical coupling between the LED elements and the plastic fibers is adjusted, the intensities of light applied to form the respective dots can individually be adjusted, so that any variations of the dot densities can further be reduced.

In each of the apparatus 10A through 10E according to the first through fifth embodiments, a color filter placed between the exposure head 14 and the lens array 26 provides an effective means for producing light beams of a desired color. The desired color of light beams may be blue for a photographic paper for use in negative development and yellow for a photographic paper for use in reversal development.

Particularly, in the apparatus 10C according to the third embodiment shown in FIG. 7, replacing the plastic fibers 124 with microlenses or using a combination of the plastic fibers 124 and microlenses is effective to increase the amount of light to be applied to the photographic paper 16.

With the arrangement of the present invention, as described above, it is possible to form latent-image dots with clear profiles and free of density variations on the photographic paper. Furthermore, since an image produced by spots of light can easily be focused onto the photographic paper, a number of spots can be formed on the photographic paper with increased efficiency.

Although certain preferred embodiments of the present invention have been shown and described in detail, it should be understood that various changes and modifications may be made therein without departing from the scope of the appended claims.

What is claimed is:

1. An apparatus for manufacturing a photographic paper, comprising:

a light source for emitting light;

a feed mechanism for feeding a photographic paper;

a light guide, said light guide comprising a cylindrical light guide rod with a light diffusion film attached to a rear surface of the light guide rod;

a fiber array, comprising a mask having an array of openings arranged at a first pitch for directing light from said light guide to the photographic paper; and a light emission controller for energizing said light source each time the photographic paper is fed a second pitch by said feed mechanism to form a matrix of dots arranged at the first pitch in the horizontal direction and the second pitch in the vertical direction as a latent image on the photographic paper.

2. An apparatus according to claim 1, wherein said light source comprises a plurality of light-emitting diode (LED) elements disposed on opposite ends of the light guide rod.

3. An apparatus according to claim 1, further comprising a lens array comprising a number of lenses disposed between said mask and the photographic paper.

4. An apparatus according to claim 1 wherein said light emission controller comprises:

a distance detector for detecting a distance by which said photographic paper is fed by said feed mechanism;

a pitch detector which outputs a trigger signal when the distance detected by said distance detector is equal to said second pitch; and a light source energizer for supplying a drive signal having a predetermined pulse duration to said light source in response to the trigger signal outputted by said pitch detector.

5. An apparatus according to claim 1, further comprising:

self-diagnosing means for confirming the emission of light from said light source.

6. An apparatus according to claim 5, wherein said self-diagnosing means comprises a photocoupler connected between said LED elements and a power supply.

7. An apparatus for manufacturing a photographic paper, comprising:

a light source for emitting light;

a feed mechanism for feeding a photographic paper;

a light guide, said light guide comprising a plurality of plastic fibers spaced at a first pitch and a box-shaped housing which supports the plastic fibers;

a fiber array, comprising a mask having an array of openings arranged at the first pitch for directing light from said light guide to the photographic paper; and a light emission controller for energizing said light source each time the photographic paper is fed a second pitch by said feed mechanism to form a matrix of dots arranged at the first pitch in the horizontal direction and the second pitch in the vertical direction as a latent image on the photographic paper.

8. An apparatus according to claim 7, wherein said light source comprises an array of LED elements (chips) and a plate-like board on which the LED elements (chips) are supported at said first pitch.

9. An apparatus according to claim 7, further comprising:

a lens array comprising a number of lenses disposed between said mask and the photographic paper.

10. An apparatus according to claim 7 wherein said light emission controller comprises:

a distance detector for detecting a distance by which said photographic paper is fed by said feed mechanism;

a pitch detector which outputs a trigger signal when the distance detected by said distance detector is equal to said second pitch; and a light source energizer for supplying a drive signal having a predetermined pulse duration to said light source in response to the trigger signal outputted by said pitch detector.

11. An apparatus according to claim 7, further comprising self-diagnosing means for confirming the emission of light from said light source.

12. An apparatus according to claim 11, wherein said self-diagnosing means comprises a photocoupler connected between said LED elements and a power supply.

13. An apparatus for manufacturing a photographic paper comprising:

a light source for emitting light;

a feed mechanism for feeding a photographic paper;

a light guide, said light guide comprising a diffusion plate;

a fiber array, comprising a mask having an array of openings arranged at a first pitch for directing light from said light guide to the photographic paper; and a light emission controller for energizing said light source each time the photographic paper is fed a second pitch by said feed mechanism to form a matrix of dots arranged at the first pitch in the horizontal direction and the second pitch in the vertical direction as a latent image on the photographic paper.

14. An apparatus according to claim 13, wherein said light source comprises an array of LED elements (chips) and a plate-like board on which the LED elements (chips) are supported at said first pitch.

15. An apparatus according to claim 13, further comprising:

a lens array comprising a number of lenses disposed between said mask and the photographic paper.

16. An apparatus according to claim 13 wherein said light emission controller comprises:

a distance detector for detecting a distance by which said photographic paper is fed by said feed mechanism;

a pitch detector which outputs a trigger signal when the distance detected by said distance detector is equal to said second pitch; and a light source energizer for supplying a drive signal having a predetermined pulse duration to said light source in response to the trigger signal outputted by said pitch detector.

17. An apparatus according to claim 13, further comprising self-diagnosing means for confirming the emission of light from said light source.

18. An apparatus according to claim 17, wherein said self-diagnosing means comprises a photocoupler connected between said LED elements and a power supply.

19. An apparatus for manufacturing a photographic paper, comprising:

a light source for emitting light;

a feed mechanism for feeding a photographic paper;

a fiber array for directing light to the photographic paper;

a light emission controller for energizing said light source each time the photographic paper is fed a second pitch by said feed mechanism to form a matrix of dots arranged at the first pitch in the horizontal direction and the second pitch in the vertical direction as a latent image on the photographic paper; and a light guide, wherein said light guide comprises:

a plurality of first plastic fibers;

a first housing for supporting said first plastic fibers at a third pitch;

a plurality of second plastic fibers arranged in bundles, wherein each of said bundles comprise between four or five of said second plastic fibers at said third pitch; and a second housing for supporting said bundles of said plurality of second plastic fibers.

20. An apparatus according to claim 19, wherein said light source comprises an array of LED elements.

21. An apparatus according to claim 19, further comprising a lens array comprising a number of lenses disposed between said fiber array and the photographic paper.

22. An apparatus according to claim 19, wherein said light emission controller comprises:

a distance detector for detecting a distance by which said photographic paper is fed by said feed mechanism;

a pitch detector which outputs a trigger signal when the distance detected by said distance detector is equal to said second pitch; and a light source energizer for supplying a drive signal having a predetermined pulse duration to said light source in response to the trigger signal outputted by said pitch detector.

23. An apparatus according to claim 19, further comprising self-diagnosing means for confirming the emission of light from said light source.

24. An apparatus according to claim 23, wherein said self-diagnosing means comprises a photocoupler connected between said LED elements and a power supply.

25. An apparatus according to claim 19, wherein said light source is coupled to a first end of said plurality of first plastic fibers.

26. An apparatus for manufacturing a photographic paper, comprising:

a light source for emitting light;

a feed mechanism for feeding a photographic paper;

an array of light transmission members arranged at a first pitch for transmitting light from said light source to the photographic paper; and a light emission controller for energizing said light source each time the photographic paper is fed a second pitch by said feed mechanism to form a matrix of dots arranged at the first pitch in the horizontal direction and the second pitch in the vertical direction as a latent image on the photographic paper, said light emission controller comprising:

a distance detector for detecting a distance by which said photographic paper is fed by said feed mechanism;

a pitch detector which outputs a trigger signal when the distance detected by said distance detector is equal to said second pitch; and a light source energizer for supplying a drive signal having a predetermined pulse duration to said light source in response to the trigger signal outputted by said pitch detector.

27. An apparatus according to claim 26, wherein said light source comprises an array of light-emitting diodes.

28. An apparatus according to claim 26, further comprising:

a light guide for guiding the light from said light source to said array of light transmission members.

29. An apparatus according to claim 26, further comprising:

a lens array comprising a number of lenses disposed between said array of light transmission members and the photographic paper.

30. An apparatus according to claim 26, further comprising:

self-diagnosing means for confirming the emission of light from said light source.

31. An apparatus according to claim 30, wherein said light source comprises an array of light-emitting diodes, said self-diagnosing means comprising a photocoupler connected between said array of light-emitting diodes and a power supply.

32. A method of manufacturing a photographic paper, comprising the steps of:

providing an array of light transmission members arranged at a first pitch for transmitting light from a light source to a photographic paper;

detecting a distance by which said photographic paper is fed by a feed mechanism;

outputting a trigger signal when the distance detected is equal to a second pitch; and energizing said light source to emit light each time a trigger signal is outputted to form a matrix of dots arranged at the first pitch in the horizontal direction and the second pitch in the vertical direction as a latent image on the photographic paper.

* * * * *